United States Patent [19]

Hayes

[11] 4,453,318

[45] Jun. 12, 1984

[54] APPARATUS FOR PRODUCING PERSPECTIVE DRAWINGS

[76] Inventor: Jess W. Hayes, 9208 Farmington Dr., Richmond, Va. 23229

[21] Appl. No.: 432,276

[22] Filed: Jan. 21, 1983

[51] Int. Cl.[3] ..... B43L 13/14

[52] U.S. Cl. ..... 33/432; 33/1 K

[58] Field of Search ..... 33/1 K, 432, 433, 434

[56] References Cited

U.S. PATENT DOCUMENTS

| | | | |
|---|---|---|---|
| 1,986,625 | 1/1935 | Lorenzi | 33/434 |
| 3,258,843 | 7/1966 | Nosser | 33/432 |
| 3,389,470 | 6/1968 | Johnson | 33/434 |
| 4,075,762 | 2/1978 | Ohtake | 33/434 |

FOREIGN PATENT DOCUMENTS

| | | | |
|---|---|---|---|
| 166201 | 6/1950 | Austria | 33/434 |

*Primary Examiner*—William D. Martin, Jr.

*Attorney, Agent, or Firm*—Norman B. Rainer

[57] ABSTRACT

An apparatus is provided for use in conjunction with a tiltable rectangular drafting table for producing perspective drawings within a working area centered on the table. The apparatus comprises a left side, right side and bottom holding means and an elongated drawing guide associated with each holding means. The extremities of the drawing guides which are located within the working area are pivotably joined at a juncture. Manual movement of the juncture causes simultaneous pivotal movement of the drawing guides about vanishing points in a manner to enable straight lines to be drawn for a perspective drawing.

6 Claims, 9 Drawing Figures

APPARATUS FOR PRODUCING PERSPECTIVE DRAWINGS

BACKGROUND OF THE INVENTION

This invention concerns apparatus for use in conjunction with a drafting table for producing perspective drawings.

In producing a perspective drawing, straight lines traveling to the left side of the drawing are made to converge at a left vanishing point, and straight lines traveling to the right side of the drawing are made to converge at a right vanishing point. Such techniques impart a depth or three-dimensional effect to the drawing. In some instances, upright lines, instead of being drawn vertical to the horizon and parallel to each other, may be caused to converge at a vanishing point above or below the drawing. In those instances where the vanishing point is on the drafting table, a pin or nail can be inserted into the table and used as an abutment pivot point for a straightedge angled toward the drawing. In such manner, all lines drawn by the pivoted straightedge will converge at the vanishing point represented by the pin.

Such use of a pin, however, eventually defaces the surface of the drafting table. Devices have been disclosed in U.S. Pat. Nos. 4,075,762; 1,986,625; and elsewhere for adjustably establishing vanishing points which constrain a straightedge. Such devices, however, are of complex design and not universally suited for use as an attachment to a conventional drafting table. Certain devices of the prior art, by virtue of their specialized construction, further sacrifice ease of use or the speed with which straightedges can be accurately positioned by the draftsman for the drawing of lines.

It is accordingly an object of the present invention to provide an apparatus for attachment to a conventional drafting table for establishing vanishing points for the production of perspective drawings.

It is another object of this invention to provide apparatus of the aforesaid nature which provides adjustably positionable left side and right side vanishing points, and straightedges associated with said vanishing points.

It is a further object of the invention to provide apparatus as in the foregoing object which can provide upper and lower vanishing points and at least one straightedge which can be utilized in conjunction with either upper or lower vanishing point.

It is a still further object of this invention to provide apparatus as in the foregoing objects of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an apparatus which comprises left side, right side, and bottom adjustable holding means, and an elongated straight-edged drawing guide associated with each holding means, said left and right side drawing guides being pivotably interconnected at their proximal extremities at a location generally between said holding means and which may be considered to be the drawing area. The inner extremity of the bottom drawing guide is interconnected with the inner extremity of the left and right side drawing guide, but not necessarily in a pivotal manner.

The left side and right side holding means are substantially identical, except for mirror-image reversal of certain component parts. Each of said side holding means is comprised of (a) a first elongated track adapted to be attached to a drafting table in perpendicular disposition between the upper and lower edges thereof, said lower edge of the table being disposed closest to the draftsman, (b) a holding plate of substantially flat configuration having a first or downwardly directed pair of guide posts which slideably engage said first elongated track, and a second or upwardly directed pair of guide posts disposed on a line perpendicular to the line between said first pair of guide posts, (c) a second elongated track slideably engaged by said upwardly directed guide posts in a disposition perpendicular to said first elongated track, said second track having an outer extremity, and an inner extremity located within or adjacent said drawing area, and (d) pivoted support means pendantly attached to said second track adjacent the inner extremity thereof.

The bottom adjustable holding means is comprised of (a) an elongated panel adapted for attachment to the lower edge of the drafting table and having an arcuate slot convexly or concavely disposed with respect to said lower edge, and (b) a guide carriage slideably associated with said arcuate slot. Some embodiments of the panel may contain a straight slot which is parallel to the lower edge of the table.

Drawing guides are slideably held by the two pivoted support means and by said guide carriage. Each drawing guide has a straightedge, an outer or distal extremity which may locate off the drafting surface, and an inner or proximal extremity adapted to be positioned within the drawing area. The inner extremities of the three drawing guides are interconnected to form a junction site capable of random placement throughout the drawing area. A junction plate may be utilized to facilitate the pivotal interconnection of the left and right drawing guides and fixed attachment of the proximal extremity of the bottom drawing guide. Handle means may be provided in association with said plate to facilitate its manual manipulation.

The apparatus of this invention is preferably utilized on a tilted drafting table but may also be utilized on untilted, horizontally disposed drafting surfaces. In operation, the junction site is moved by the draftsman to an appropriate location within the drawing area for the drawing of straight lines utilizing the straightedges associated with said drawing guides. At each location of the junction site, the left and right drawing guides provide vanishing points which are fixed for a given drawing. The bottom drawing guide provides a vanishing point which is above the drawing when the arcuate slot is concave with respect to the lower edge of the drafting table, and below the drawing when the arcuate slot is convex with respect to said lower edge. The upper or lower vanishing point is the center of curvature of the arcs of said slots. When a straight horizontal slot parallel to said lower edge is employed in the bottom holding means, there will be no upper or lower vanishing points, in which case all lines drawn utilizing the drawing guide associated with said bottom holding means will be parallel to each other and perpendicular to said lower edge.

The location of the left or right side vanishing points may be adjustably selected by suitable movement of said holding plate along said first track, and movement of said second track with respect to said holding plate. Clamping means are preferably associated with the guide posts of said holding plates to adjustably secure the relative positions of the plate and tracks.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF A PREFERRED EMBODIMENT

Figure 1:
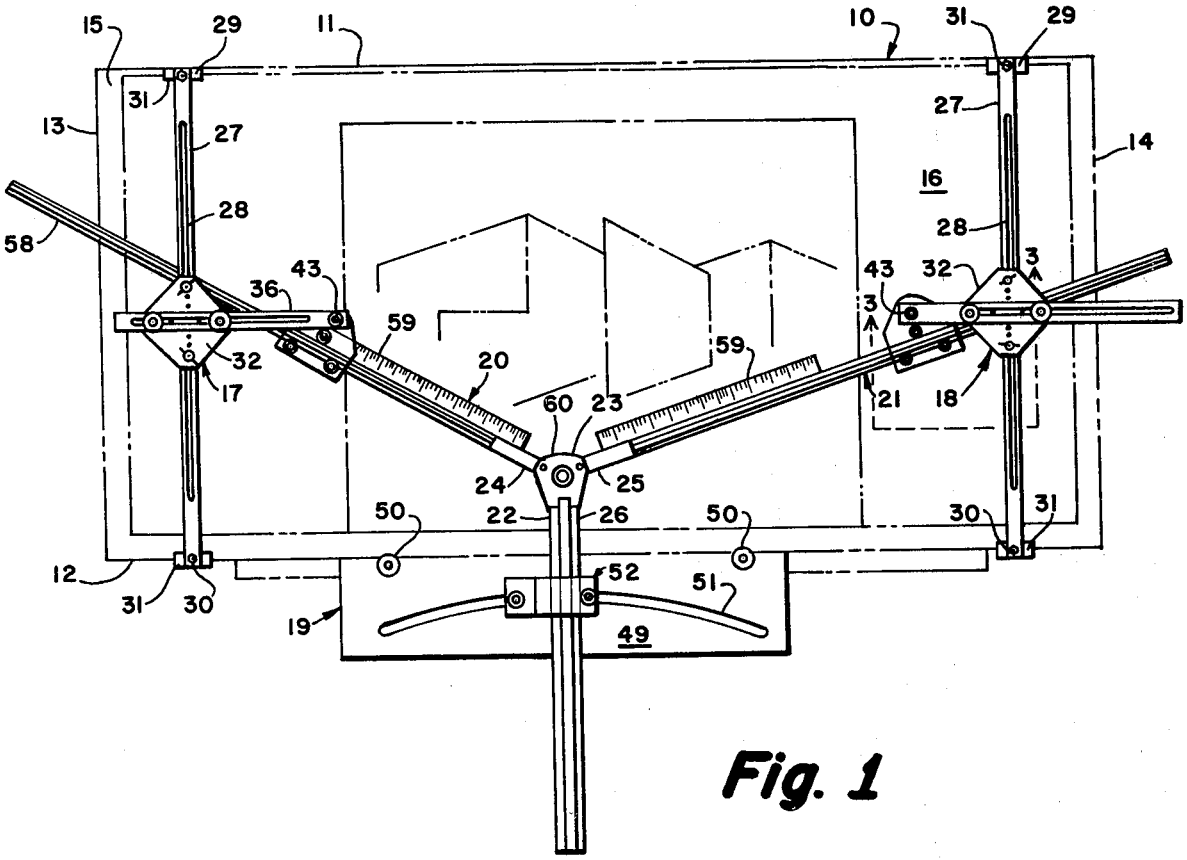
FIG. 1 is a plan view of an embodiment of the apparatus of this invention shown in association with a drafting table.
Figure 2:
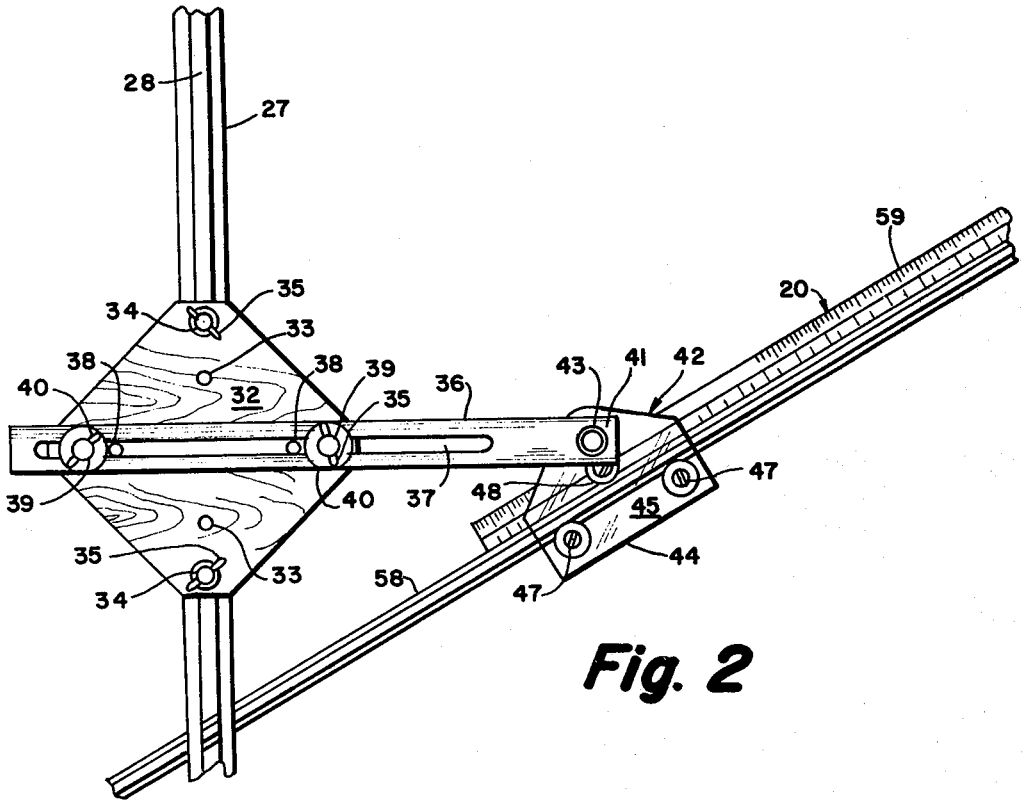
FIG. 2 is an enlarged fragmentary plan view of the left side holding means shown in FIG. 1.

Referring to FIGS. 1 and 2, apparatus of the present invention is shown in operational disposition on a drafting table 10 having upper edge 11, lower edge 12, left side edge 13, right side edge 14 and working surface 15. A sheet of paper 16 containing a perspective drawing is positioned upon said working surface.

The apparatus of the present invention is comprised of left holding means 17, right holding means 18, bottom holding means 19, drawing guides 20, 21 and 22 associated with holding means 17, 18 and 19 respectively, and junction plate 23 to which inner extremities 24 and 25 of drawing guides 20 and 21 respectively are pivotably joined, and to which the inner extremity 26 of drawing guide 22 is fixedly joined.

The left side and right side holding means are substantially identical, except for mirror-image reversal of certain component parts. Each of said side holding means is comprised of a first elongated track 27 which is a rigid member having an elongated slot 28, and upper and lower extremities designated 29 and 30 respectively, said extremities having clamping means 31 adapted to fasten track 27 to the upper and lower edges of the drafting table. In certain embodiments, track 27 may be comprised of two telescopically interactive members adapted to modify its effective length to accommodate drafting tables of different sizes. Track 27 is preferably maintained a fixed distance off the surface of the drafting table in order to permit passage thereunder of drawing guide 20 or 21. A holding plate 32 of substantially flat configuration rests upon track 27. Longitudinally paired apertures 33 in plate 32 are adapted to receive bolts 34 disposed below said plate in sliding engagement with slot 28 and which serve as guide posts for the movement of holding plate 32 along track 27. As shown more clearly in FIGS. 2 and 3, bolts 34 are provided with heads 63 adapted to ride in a trough-like recess 64 associated with slot 28 along the underside of track 27. Clamping means such as wing nuts 35 threadably engaging bolts 34 and interactive with heads 63 enable holding plate 32 to be immobilized with respect to track 27.

A second elongated track 36 having slot 37 rests upon holding plate 32. Laterally paired apertures 38 in holding plate 32 are adapted to receive bolts 39 which extend upwardly in sliding engagement with slot 37 and serve as guide posts for the movement of track 36 across holding plate 32 in a direction perpendicular to track 27. Fastening means such as wing nuts 35 interactive with bolts 39, and associated washers 40 enable track 36 to be immobilized with respect to holding plate 32.

A support means 42 for a drawing guide such as 20 is held to the inner extremity 41 of track 36 by pivot post 43. Said support means is comprised of baseplate 44 having an upper surface 45 which attaches to pivot post 43, and a lower surface 46 equipped with paired lower grooved wheels 47 and upper grooved wheel 48 spaced apart from wheels 47 on the perpendicular bisector of the line between wheels 47.

Figure 3:
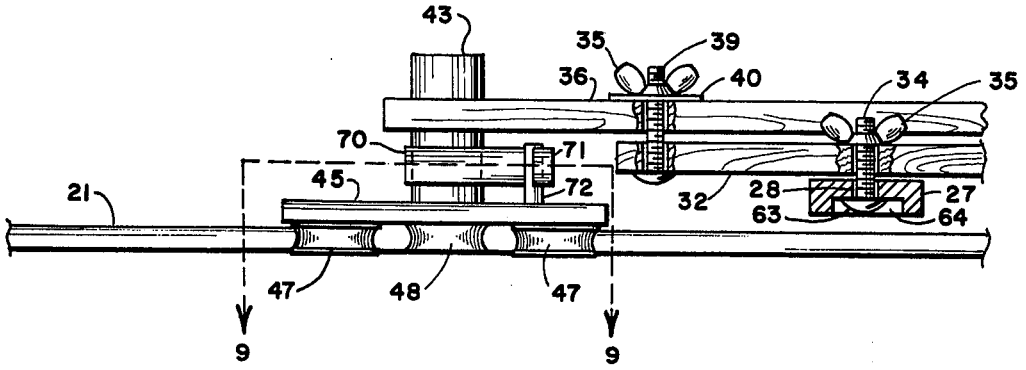
FIG. 3 is an enlarged end view of the right side holding means taken along the line 3—3 of FIG. 1.
Figure 9:
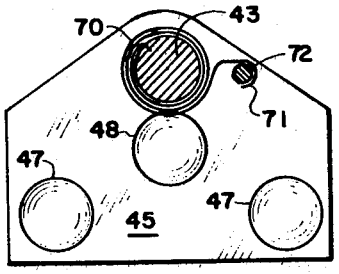
FIG. 9 is a sectional view taken along the line 9—9 of FIG. 3.
Figure 8:
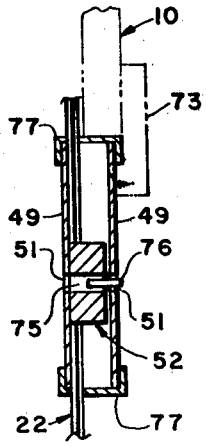
FIG. 8 is a fragmentary end view of the embodiment of bottom holding means of FIG. 7.

A spring-biasing system may be incorporated into the left side and right side holding means. The purpose of such biasing system being to overcome the tendency of the three interconnected drawing guides 20, 21 and 22 to fall by gravity to lower portions of a tilted table. An embodiment of spring biasing system is shown in FIGS. 3 and 9 comprised of a coiled flat spring 70 which wraps around pivot post 43, the inner end of said spring being affixed to pivot post 43. The free end 71 of spring 70 loops around and engages anchor post 72 affixed to the upper surface 45 of support means 42. By virtue of the spring effect, post 76 is forced downwardly, causing support means 42 to pivot about pivot post 43 and thereby apply lifting force to the inner extremities of left or right side drawing guides. The amount of tension on spring 70 may be adjusted by causing more or less coils of said spring to be wound around post 43 before placing its free end on anchor post 72.

Figure 4:
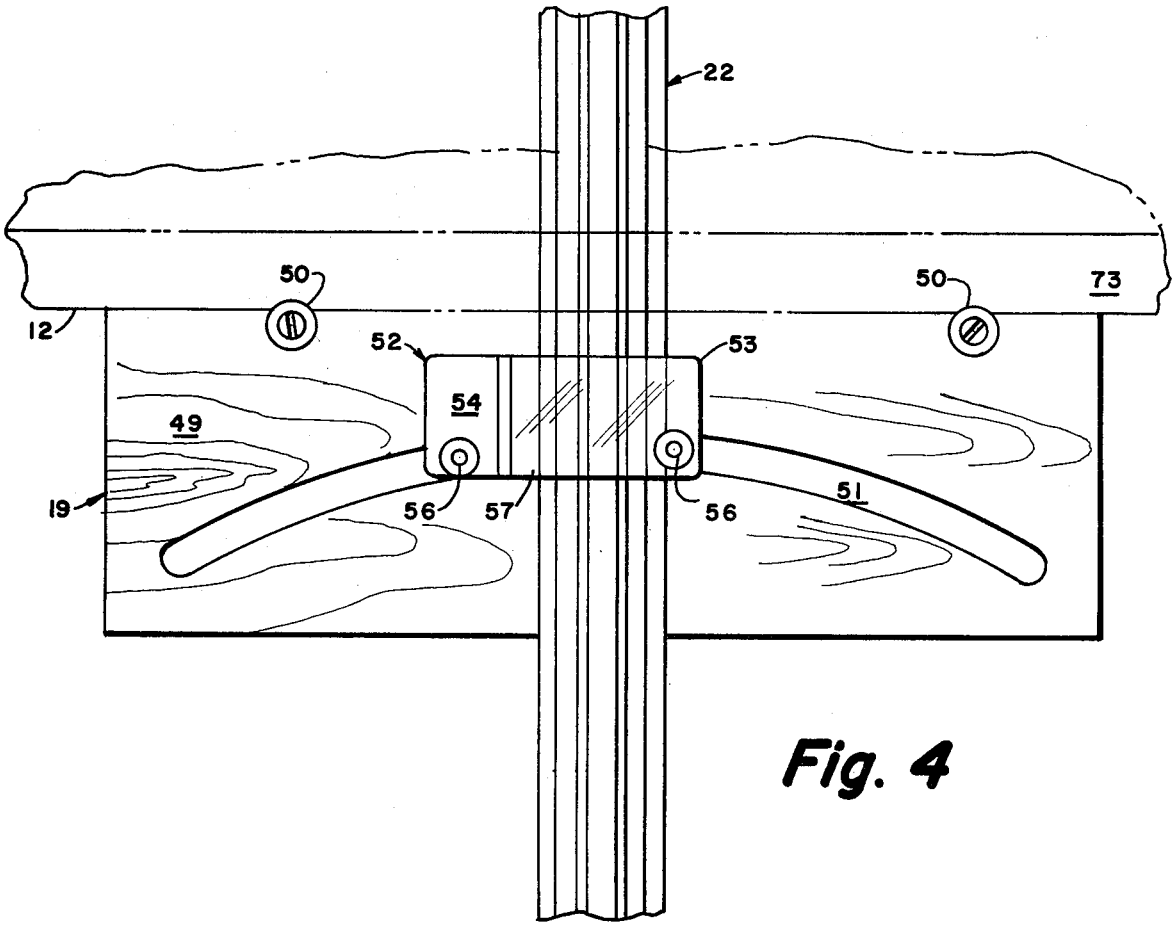
FIG. 4 is an enlarged fragmentary plan view of the bottom holding means shown in FIG. 1.
Figure 5:
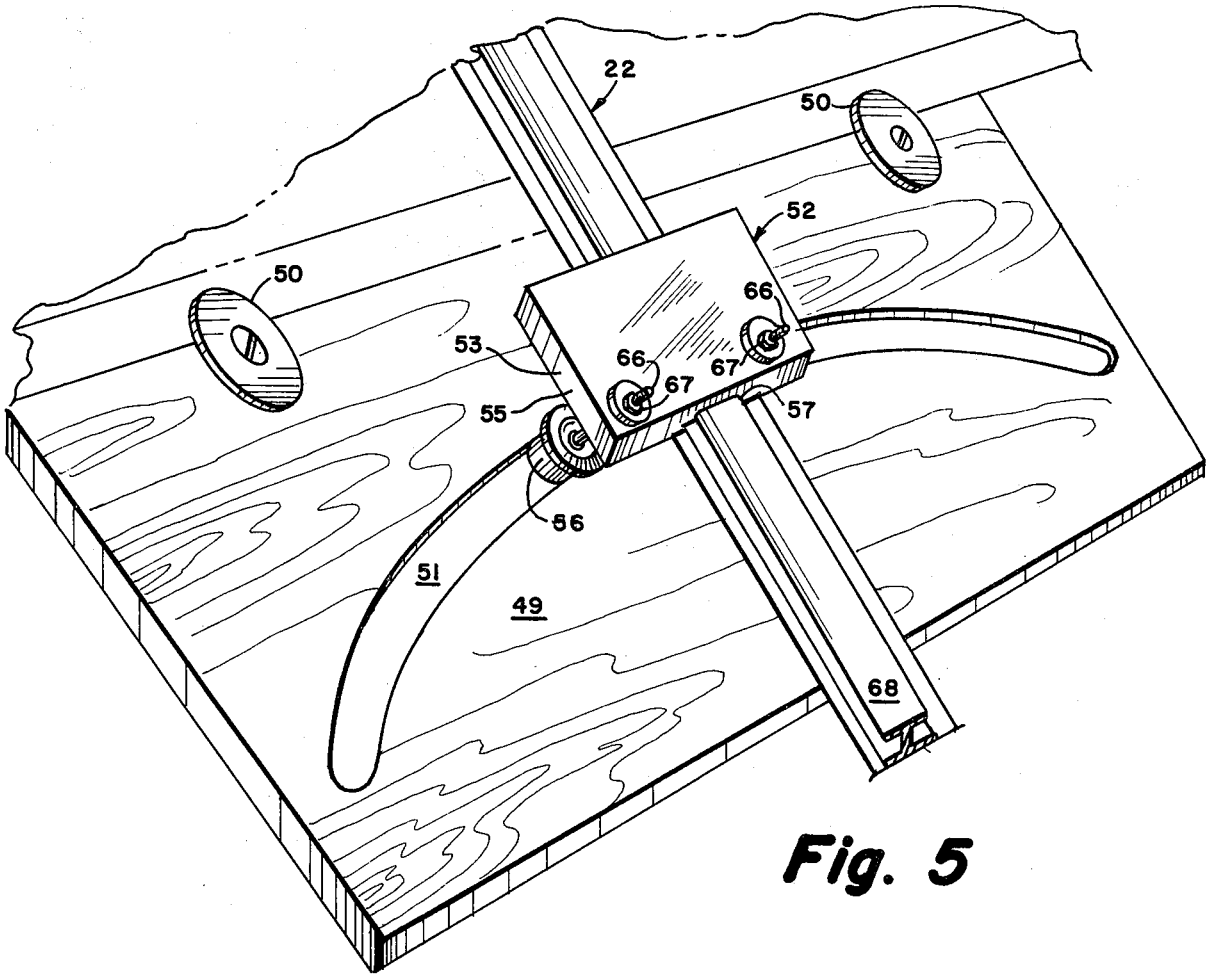
FIG. 5 is a perspective view of the bottom holding means shown in FIG. 4.
Figure 6:
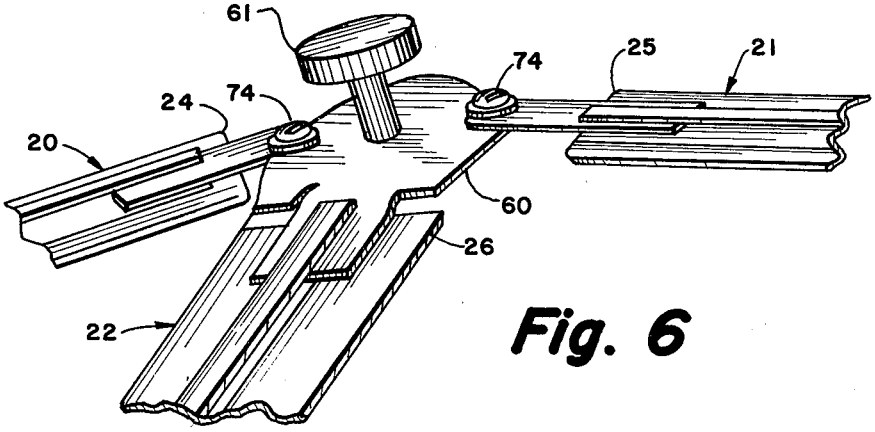
FIG. 6 is an enlarged top perspective view of the junction plate of FIG. 1.
Figure 7:
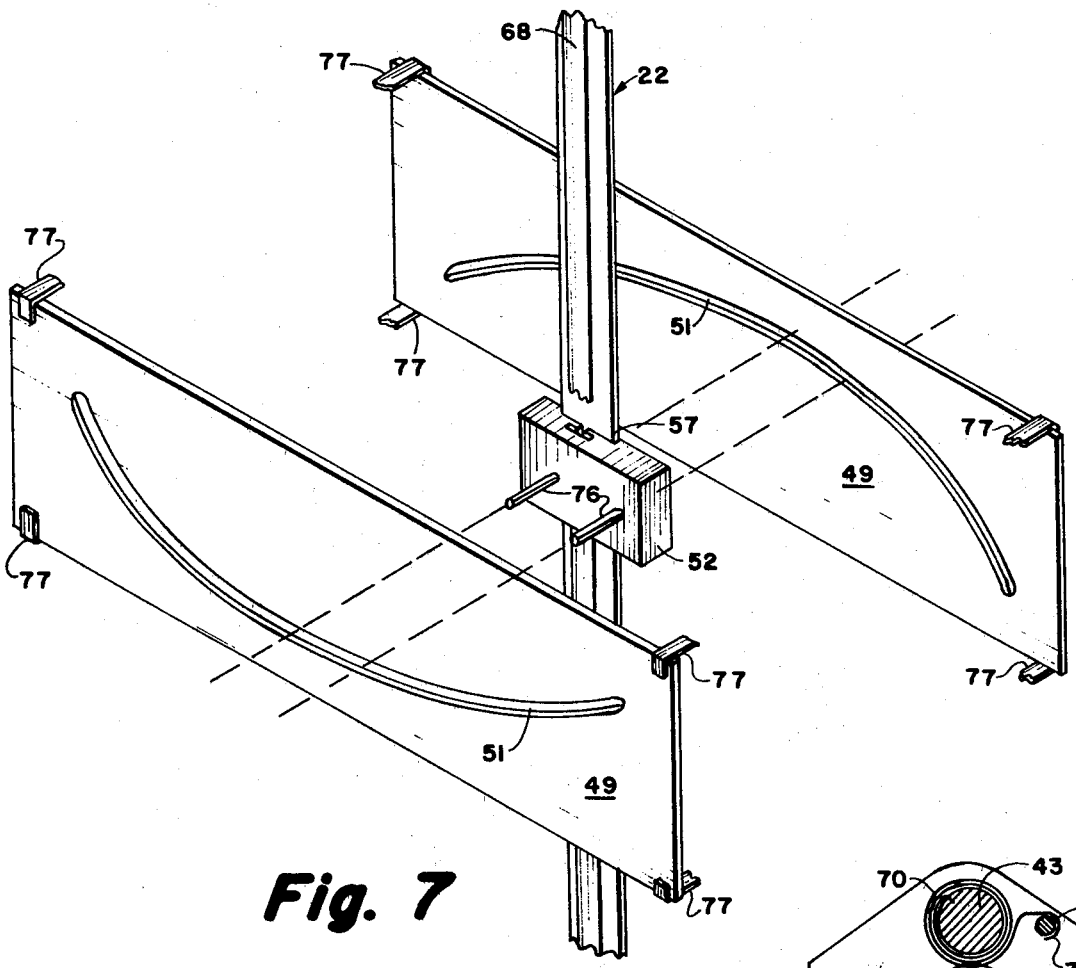
FIG. 7 is an exploded perspective view of an alternative embodiment of bottom holding means.

As shown more clearly in FIGS. 4 and 5, the bottom adjustable holding means 19 is comprised of elongated flat rectangular panel 49 attached by paired clamping means 50 and rear buttressing strip 73 to the lower edge of the drafting table, said panel having at least one arcuate slot 51 therein. Slot 51 is a circular arc convexly oriented with respect to the drafting table and adapted to provide a vanishing point below the drawing. Additional slots of different radii of curvature and concave or convex disposition may be incorporated into panel 49. A straight horizontal slot may also be employed in panel 49. A guide carriage 52 is movably associated with slot 51. The carriage is comprised of a baseplate 53 having an upper face 54 and lower face 55. To the lower face is attached by means of bolts 66 and 67 two spaced-apart rollers 56 adapted to establish rolling engagement with slot 51. A channel 57 of T-cross section within lower face 55 is positioned between rollers 56 and oriented perpendicularly to the line therebetween.

Drawing guide 20 is comprised of long straight member 58 and straightedge ruler 59 attached to member 58 adjacent its inner extremity 24. Long member 58 is movably engaged by rollers 47 and 48 of support means 42. Drawing guide 21 is constructed in identical manner to drawing guide 20 and is movably held by the support means of holding means 18 in a manner such that the inner extremities of drawing guides 20 and 21 are directed toward each other within the drawing area. The upper faces of the long members of drawing guides 20 and 21 are preferably provided with an upraised T-shaped track to facilitate gripping by rollers 47 and 48.

Drawing guide 22 is slideably engaged by channel 57 of the guide carriage of bottom holding means 19. The manner of such engagement, shown in FIG. 5 is achieved by the sliding movement of track 68 within channel 57. The inner extremity 26 of drawing guide 22 is directed toward the inner extremities of drawing guides 20 and 21 within the drawing area. The inner extremities of all three drawing guides are attached to a junction plate 60 provided with a manipulator knob 61. Whereas drawing guides 20 and 21 are attached by pivot means 74 to plate 50, drawing guide 22 is fixedly attached to said plate.

In operation, movement of junction plate 60 causes simultaneous movement of the three drawing guides in a manner whereby each drawing guide pivots about its vanishing point. In the case of the side drawing guides 20 and 21, the vanishing points are pivot posts 43. In the case of bottom drawing guide 22, the vanishing point is the center of curvature of arcuate slot 51. In this sense, drawing guide 22 behaves as a radius of the circle of which slot 51 is an arc.

In view of its manner of construction and function, the apparatus of this invention enables a draftsman to quickly position junction plate 60 in a manner such that lines drawn along either of the three drawing guides will be accurate with regard to their respective vanishing points.

In a particularly preferred embodiment of the bottom holding means 19, two panels 49 are provided, and a modified guide carriage 52 is sandwiched therebetween. Each panel has a differently shaped slot 51, the panels being held in close parallel adjacency by clamps 77. The modified guide carriage is provided adjacent one face with a T-shaped channel 57 which accommodates T-shaped track 68 of drawing guide 22. Two cylindrical channels 75 are provided in carriage 52 in parallel juxtaposition equally spaced from channel 57 and perpendicular thereto. Fitted within channels 75 are close-fitting pegs 76 adapted to be frictionally positioned either entirely within carriage 52, or protruding from either face thereof. When the pegs protrude in one direction they engage the slot in one panel, functioning in a manner analogous to the rollers 56 of FIGS. 4 and 5. When protruding in the opposite direction, they engage the slot of the opposite panel. In this manner, the draftsman has the option of easily changing between an upper vanishing point and a lower vanishing point.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for use in conjunction with a rectangular drafting table for producing perspective drawings within a working area on said table comprising:

(a) left side and right side holding means, each comprised of (1) an elongated first track adapted to be disposed on said drafting table perpendicularly between the upper and lower edges thereof and adapted to attach to said table adjacent said upper and lower edges, (2) a holding plate of substantially flat configuration disposed above said first track, (3) means for slideably engaging said holding plate with said first track, (4) an elongated second track positioned above said holding plate and perpendicular to said first track, said second track having inner and outer extremities, (5) means for slideably engaging said holding plate with said second track, and (6) pivoted support means pendantly attached to said second track adjacent the inner extremity thereof, (b) a bottom adjustable holding means comprised of (1) an elongated panel adapted for attachment to the lower edge of the drafting table and having at least one arcuate slot symmetrically disposed about the perpendicular bisector of said panel and (2) a guide carriage movably associated with said arcuate slot, and (c) drawing guides slideably held by said pivoted support means and said guide carriage, said drawing guides each having an outer extremity, and an inner extremity adapted to be positioned within said working area, (d) the inner extremities of the drawing guides held by said pivoted support means being pivotably interconnected at a juncture, the inner extremity of the drawing guide held by said guide carriage also interconnected at said juncture, (e) whereby manual movement of said juncture causes simultaneous pivotal movement of said drawing guides about three vanishing points in a manner to enable straight lines to be drawn for a perspective drawing.

2. The apparatus of claim 1 wherein said arcuate slot is an arc of a circle.

3. Apparatus of claim 1 wherein said pivoted support means has associated therewith spring-biasing means adapted to minimize falling movement of said drawing guides on a tilted drafting table.

4. The apparatus of claim 1 wherein said bottom holding means provides for both upper and lower vanishing points.

5. The apparatus of claim 1 wherein said juncture is a substantially flat plate-like structure.

6. Apparatus of claim 1 wherein said pivoted support means is provided with upper and lower rollers which permit controlled sliding passage of said drawing guide.

* * * * *